US010072396B2

(12) United States Patent
Yoshida et al.

(10) Patent No.: US 10,072,396 B2
(45) Date of Patent: Sep. 11, 2018

(54) WORKING MACHINE CONTROL SYSTEM

(71) Applicant: KYB Corporation, Tokyo (JP)

(72) Inventors: Nobuyoshi Yoshida, Tokyo (JP); Ikuo Inagaki, Saitama (JP)

(73) Assignee: KYB Corporation, Tokyo (JP)

( * ) Notice: Subject to any disclaimer, the term of this patent is extended or adjusted under 35 U.S.C. 154(b) by 242 days.

(21) Appl. No.: 15/113,486

(22) PCT Filed: Jan. 27, 2015

(86) PCT No.: PCT/JP2015/052207
§ 371 (c)(1),
(2) Date: Jul. 22, 2016

(87) PCT Pub. No.: WO2015/115429
PCT Pub. Date: Aug. 6, 2015

(65) Prior Publication Data

US 2017/0009430 A1 Jan. 12, 2017

(30) Foreign Application Priority Data

Jan. 31, 2014 (JP) ..... 2014-016495

(51) Int. Cl.
*E02F 9/22* (2006.01)
*F15B 11/17* (2006.01)
(Continued)

(52) U.S. Cl.
CPC ..... *E02F 9/2225* (2013.01); *E02F 9/2232* (2013.01); *E02F 9/2235* (2013.01); *E02F 9/2239* (2013.01); *E02F 9/2267* (2013.01); *E02F 9/2282* (2013.01); *E02F 9/2285* (2013.01); *E02F 9/2292* (2013.01); *E02F 9/2296* (2013.01); *F15B 11/00* (2013.01);
(Continued)

(58) Field of Classification Search
CPC ..... F15B 11/17; F15B 11/162; F15B 2211/30595; F15B 7711/7142; F15B 2211/45; E02F 9/2225; E02F 9/2232; E02F 9/2239; E02F 9/2285
USPC ..... 60/445
See application file for complete search history.

(56) References Cited

U.S. PATENT DOCUMENTS 6,330,797 B1 12/2001 Kondo

FOREIGN PATENT DOCUMENTS

CN 101946096 A 1/2011
JP H10-88627 A 4/1998

*Primary Examiner* — Nathaniel Wiehe
*Assistant Examiner* — Daniel Collins
(74) *Attorney, Agent, or Firm* — Rabin & Berdo, P.C.

(57) ABSTRACT

A working machine control system includes: a split-flow fluid pressure pump configured to discharge a working fluid from a first discharge port and a second discharge port; a communication switching valve configured to be switched by a switch signal when any one of a first operation valve and a second operation valve is switched so as to allow a first neutral passage and a second neutral passage to communicate with each other; a neutral cut valve configured to be switched by the switch signal so as to block communication between a tank and one of the first neutral passage and the second neutral passage for the first operation valve or the second operation valve that is not switched; and a discharge flow rate adjusting device configured to adjust the fluid pressure pump so as to reduce a discharge flow rate thereof when the switch signal is inputted from any one of the first operation valve and the second operation valve.

5 Claims, 5 Drawing Sheets

(51) Int. Cl.

| | |
|---|---|
| ***F15B 11/00*** | (2006.01) |
| ***F15B 11/16*** | (2006.01) |
| ***F15B 13/02*** | (2006.01) |
| ***F15B 13/06*** | (2006.01) |
| *E02F 3/32* | (2006.01) |

(52) U.S. Cl.

CPC ..... *F15B 11/16* (2013.01); *F15B 11/17* (2013.01); *F15B 13/022* (2013.01); *F15B 13/06* (2013.01); *E02F 3/32* (2013.01); *F15B 2211/20553* (2013.01); *F15B 2211/20576* (2013.01); *F15B 2211/30595* (2013.01); *F15B 2211/327* (2013.01); *F15B 2211/329* (2013.01); *F15B 2211/36* (2013.01); *F15B 2211/41554* (2013.01); *F15B 2211/426* (2013.01); *F15B 2211/428* (2013.01); *F15B 2211/45* (2013.01); *F15B 2211/6652* (2013.01); *F15B 2211/71* (2013.01); *F15B 2211/7142* (2013.01)

100
37
38
37b
37a
35
37c
70
50
30
34a 74
74a 34b
34b
33a 73
73a 33b
34a
34
32a 72
72a 32b
33b
31a 71
71a 31b
33a
33
36
65
75
32b
80
61a
21a 61
21b
81
32a
32
82
35
22a 62
62a
22b
31a
31b
19
11a
23a 63
63a 23b
42
31
13
16
40
40a
16a
18
60
40d
40e
11
40b
40c
15a
41
21
10
12
15
21a
21b
22a
22
22b
25
26
23a
23
23b 27c
28
27b
27a
27
25
19
20

WORKING MACHINE CONTROL SYSTEM

TECHNICAL FIELD

The present invention relates to a working machine control system.

BACKGROUND ART

Heretofore, a working machine, such as a hydraulic excavator, is known that is provided with a plurality of circuit systems to each of which working oil is supplied from corresponding one of a plurality of hydraulic pumps. JP10-088627A discloses an excavation turning working machine in which a first pump, a second pump, and a third pump supply working oil to respective circuit systems.

Further, in some working machines, such as hydraulic excavators, there is a case where a split-flow pump is used in place of two hydraulic pumps. The split-flow pump has a single cylinder block provided with two separate discharge ports to allow working oil to be discharged to two systems at the same time.

SUMMARY OF INVENTION

However, in a case where the split-flow pump is used, discharge flow rates of the working oil by the two circuit systems are the same. Therefore, in a case where the split-flow pump is applied to the working machine described in JP10-088627A and an actuator is operated by switching only an operation valve of one of the circuit systems, working oil to be supplied to the other circuit system is directly returned to a tank.

It is an object of the present invention to improve energy efficiency in a case where a split-flow pump is used in a working machine provided with a plurality of circuit systems.

According to an aspect of the present invention, there is provided a working machine control system configured to control a working machine including a first actuator and a second actuator, the working machine control system including: a split-flow fluid pressure pump configured to discharge a working fluid from a first discharge port and a second discharge port; a first circuit system to which the working fluid discharged from the first discharge port is supplied, the first circuit system including a first operation valve and a first neutral passage, the first operation valve being configured to control the first actuator, the first neutral passage allowing the first discharge port to communicate with a tank in a state where the first operation valve is placed at a normal position; a second circuit system to which the working fluid discharged from the second discharge port is supplied, the second circuit system including a second operation valve and a second neutral passage, the second operation valve being configured to control the second actuator, the second neutral passage allowing the second discharge port to communicate with the tank in a state where the second operation valve is placed at a normal position; a communication switching valve configured to be switched by a switch signal when any one of the first operation valve and the second operation valve is switched so as to allow the first neutral passage and the second neutral passage to communicate with each other; a neutral cut valve provided in at least one of the first circuit system and the second circuit system, the neutral cut valve being configured to be switched by the switch signal so as to block communication between the tank and one of the first neutral passage and the second neutral passage for the other of the first operation valve and the second operation valve that is not switched; and a discharge flow rate adjusting device configured to adjust the fluid pressure pump so as to reduce a discharge flow rate of the fluid pressure pump in a case where the switch signal is inputted from any one of the first operation valve and the second operation valve.

DESCRIPTION OF EMBODIMENTS

Hereinafter, embodiments of the present invention will be described with reference to the drawings.

First Embodiment

Hereinafter, a working machine control system (hereinafter, referred to simply as a "control system") 100 according to a first embodiment of the present invention will be described with reference to FIGS. 1 to 4.

Figure 1:
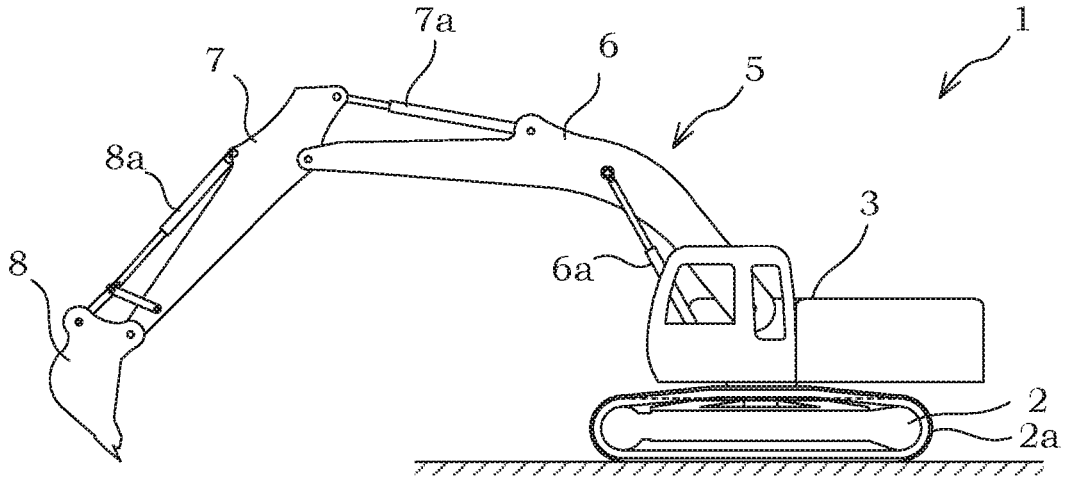
FIG. 1 is a configuration diagram of a working machine to which each of working machine control systems according to first and second embodiments of the present invention are applied.

First, a hydraulic excavator 1 serving as a working machine, to which the control system 100 is applied, will be described with reference to FIG. 1. A case where the working machine is the hydraulic excavator 1 will be described herein. However, the control system 100 can also be applied to other working machines, such as a wheel loader. Further, although working oil is used as a working fluid herein, other fluids, such as working water, may be used as the working fluid.

The hydraulic excavator 1 includes a crawler type travelling unit 2, a turning unit 3 turnably provided on the travelling unit 2, and an excavating unit 5 provided at a central portion of a front part of the turning unit 3.

The travelling unit 2 causes the hydraulic excavator 1 to travel by driving a pair of left and right crawlers 2*a* by means of a travelling motor (not shown in the drawings). The turning unit 3 is driven by a turning motor (not shown in the drawings), and turns in a left or right direction relative to the travelling unit 2.

The excavating unit 5 includes a boom 6, an arm 7, and a bucket 8. The boom 6 is pivotably supported around a horizontal shaft extending in a right-and-left direction of the turning unit 3. The arm 7 is pivotably supported at a leading end of the boom 6. The bucket 8 is pivotably supported at a leading end of the arm 7, and is configured to excavate earth and sand or the like. The excavating unit 5 also includes a boom cylinder 6*a*, an arm cylinder 7*a*, and a bucket cylinder 8*a*. The boom cylinder 6*a* causes the boom 6 to pivot upward and downward. The arm cylinder 7*a* causes the arm 7 to pivot upward and downward. The bucket cylinder 8*a* causes the bucket 8 to pivot.

Figure 2:
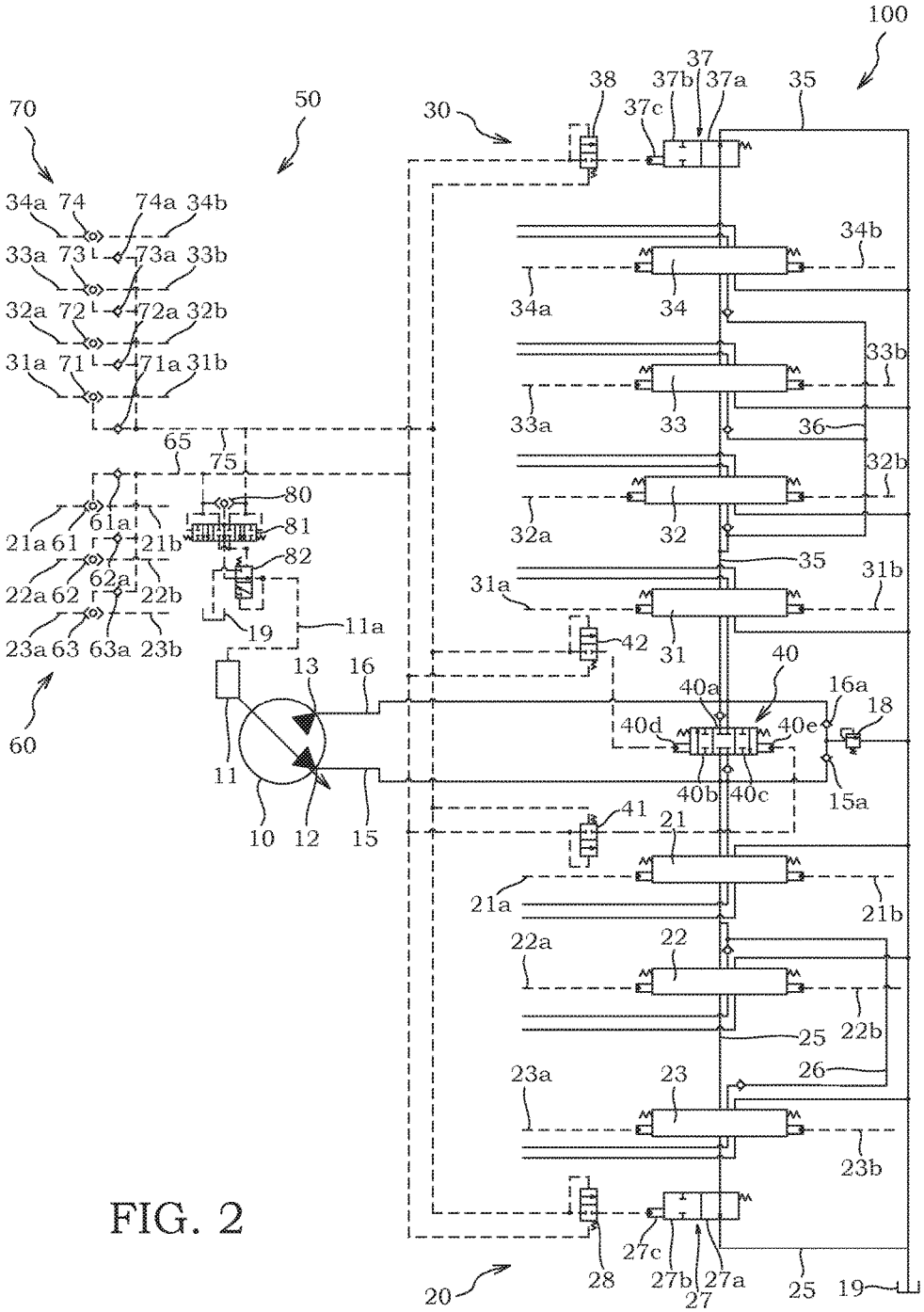
FIG. 2 is a circuit diagram of the working machine control system according to the first embodiment of the present invention.

Next, a configuration of the control system 100 will be described with reference to FIGS. 2 and 3.

The control system 100 includes a hydraulic pump 10, a first circuit system 20, a second circuit system 30, a communication switching valve 40, and a discharge flow rate adjusting mechanism 50. The hydraulic pump 10 serves as a fluid pressure pump that discharges working oil. The working oil discharged from a first discharge port 12 is supplied to the first circuit system 20. The working oil discharged from a second discharge port 13 is supplied to the second circuit system 30. The communication switching valve 40 is switched by a pilot pressure when any one group of operation valves 21 to 23 in the first circuit system 20 and operation valves 31 to 34 in the second circuit system 30 is switched so as to allow a first neutral passage 25 of the first circuit system 20 and a second neutral passage 35 of the second circuit system 30 to communicate with each other. The discharge flow rate adjusting mechanism 50 serves as a discharge flow rate adjusting device that is configured to adjust the hydraulic pump 10 so as to reduce a discharge flow rate of the hydraulic pump 10 in a case where a pilot pressure is inputted from any one group of the operation valves 21 to 23 and the operation valves 31 to 34. Here, the pilot pressure for switching the operation valves 21 to 23 or the operation valves 31 to 34 corresponds to a switch signal.

The control system 100 controls operations of a plurality of actuators of the hydraulic excavator 1. The control system 100 includes, in addition to the hydraulic pump 10, another pump (not shown in the drawings) that supplies working oil to a third circuit system (not shown in the drawings) provided with other actuators, such as a turning motor.

The hydraulic pump 10 is driven by an engine (not shown in the drawings). The hydraulic pump 10 is a split-flow pump that has a single cylinder block (not shown in the drawings) provided with two separate discharge ports including the first discharge port 12 and the second discharge port 13, and can thus discharge working oil to two systems at the same time. The hydraulic pump 10 discharges working oil from the first discharge port 12 and the second discharge port 13 on a pro rata basis.

The hydraulic pump 10 is a variable displacement pump that includes a swash plate (not shown in the drawings) whose inclination angle is adjusted by a regulator 11 to be controlled by a pilot pressure. The discharge flow rate thereof is adjusted by the inclination angle of the swash plate. In the hydraulic pump 10, the inclination angle of the swash plate is adjusted in such a manner that the higher a pilot pressure is, the more the discharge flow rate increases. The pressure of the working oil adjusted by the discharge flow rate adjusting mechanism 50 is used as the pilot pressure. The single regulator 11 adjusts the discharge flow rates of the working oil discharged from the first discharge port 12 and the second discharge port 13 in the hydraulic pump 10.

The working oil discharged from the hydraulic pump 10 is supplied to the first circuit system 20 and the second circuit system 30, respectively via a first discharge passage 15 connected to the first discharge port 12 and a second discharge passage 16 connected to the second discharge port 13.

A main relief valve 18 is provided downstream of the first discharge passage 15 and the second discharge passage 16. When a pressure exceeds a predetermined main relief pressure, the main relief valve 18 opens to maintain the pressure of the working oil at the main relief pressure or lower. Check valves 15*a* and 16*a* are respectively provided on the first discharge passage 15 and the second discharge passage 16. Each of the check valves 15*a* and 16*a* permits only the working oil to flow to the main relief valve 18. The predetermined main relief pressure is set to be higher to an extent that the minimum working pressure (will be described later) of each of the operation valves 21 to 23, 31 to 34 can be sufficiently secured.

The first circuit system 20 includes the operation valves 21, 22, and 23 in this order from an upstream side thereof. The operation valve 21 controls the travelling motor for the left crawler 2*a*. The operation valve 22 controls the boom cylinder 6*a*. The operation valve 23 controls the bucket cylinder 8*a*. These operation valves 21 to 23 correspond to a first operation valve. These travelling motor, boom cylinder 6*a*, and bucket cylinder 8*a* correspond to a first actuator. The first circuit system 20 includes the first neutral passage 25 and a parallel passage 26. The first neutral passage 25 allows the first discharge passage 15 to communicate with a tank 19 in a state where all of the operation valves 21 to 23 are at normal positions. The parallel passage 26 is arranged in parallel with the first neutral passage 25.

Each of the operation valves 21 to 23 controls an operation of the corresponding actuator by controlling the flow rate of the working oil guided from the hydraulic pump 10 to the corresponding actuator. Each of the operation valves 21 to 23 is operated by a pilot pressure that is supplied when an operator of the hydraulic excavator 1 manually operates an operation lever.

Normally, the operation valve 21 is placed at a normal position due to biasing forces of a pair of centering springs. The operation valve 21 is switched between a first switching position and a second switching position by a pilot pressure supplied from each of pilot passages 21*a*, 21*b*. Normally, the operation valve 22 is placed at a normal position due to biasing forces of a pair of centering springs. The operation valve 22 is switched between a first switching position and a second switching position by a pilot pressure supplied from each of pilot passages 22*a*, 22*b*. Normally, the operation valve 23 is placed at a normal position due to biasing forces of a pair of centering springs. The operation valve 23 is switched between a first switching position and a second switching position by a pilot pressure supplied from each of pilot passages 23*a*, 23*b*.

A neutral cut valve 27 is provided on the first neutral passage 25 downstream of the operation valve 23. The neutral cut valve 27 serving as a first neutral cut valve is switched by a pilot pressure acting on the operation valves 31 to 34 in the second circuit system 30 so as to block the first neutral passage 25. The neutral cut valve 27 blocks communication between the first neutral passage 25 and the tank 19 when the operation valves 31 to 34 in the second circuit system 30 are switched.

The neutral cut valve 27 has a communication position 27*a* for allowing communication of the first neutral passage 25, and a block position 27*b* for blocking the first neutral passage 25. Normally, the neutral cut valve 27 is placed at the communication position 27*a* due to biasing force of a return spring. The neutral cut valve 27 is switched to the block position 27*b* by a pilot pressure supplied to a pilot chamber 27*c*.

An opening/closing valve 28 is provided upstream of the pilot chamber 27*c*. The opening/closing valve 28 opens when a pilot pressure in a second pilot passage 75 (will be described later) is higher than a pilot pressure in a first pilot passage 65 by a predetermined pressure difference set up in advance or higher. This predetermined pressure difference set up in advance is a pressure difference between the first pilot passage 65 and the second pilot passage 75 in a case where only the operation valves 31 to 34 have been switched.

The second circuit system 30 includes the operation valves 31, 32, 33, and 34 in this order from an upstream side thereof. The operation valve 31 controls a travelling motor for the right crawler 2*a*. The operation valves 32 and 33 control an auxiliary actuator. The operation valve 34 controls the arm cylinder 7*a*. These operation valves 31 to 34 correspond to a second operation valve. These travelling motor, auxiliary actuator, and arm cylinder 7*a* correspond to a second actuator. The second circuit system 30 includes the second neutral passage 35 and a parallel passage 36. The second neutral passage 35 allows the second discharge passage 16 to communicate with the tank 19 in a state where all of the operation valves 31 to 34 are at normal positions. The parallel passage 36 is arranged in parallel with the second neutral passage 35.

Each of the operation valves 31 to 34 controls operations of a corresponding actuator by controlling the flow rate of the working oil guided from the hydraulic pump 10 to the corresponding actuator. Each of the operation valves 31 to 34 is operated by a pilot pressure that is supplied when the operator of the hydraulic excavator 1 manually operates the operation lever.

Normally, the operation valve 31 is placed at a normal position due to biasing forces of a pair of centering springs. The operation valve 31 is switched between a first switching position and a second switching position by a pilot pressure respectively supplied from pilot passages 31*a*, 31*b*. Normally, the operation valve 32 is placed at a normal position due to biasing forces of a pair of return springs. The operation valve 32 is switched between a first switching position and a second switching position by a pilot pressure supplied from pilot passages 32*a*, 32*b*. Normally, the operation valve 33 is placed at a normal position due to biasing forces of a pair of return springs. The operation valve 33 is switched between a first switching position and a second switching position by a pilot pressure respectively supplied from pilot passages 33*a*, 33*b*. Normally, the operation valve 34 is placed at a normal position due to biasing forces of a pair of return springs. The operation valve 34 is switched between a first switching position and a second switching position by a pilot pressure respectively supplied from pilot passages 34*a*, 34*b*.

A neutral cut valve 37 is provided downstream of the operation valve 34 in the second neutral passage 35. The neutral cut valve 37 serving as a second neutral cut valve is switched by a pilot pressure acting on the operation valves 21 to 23 in the first circuit system 20 so as to block the second neutral passage 35. The neutral cut valve 37 blocks communication between the second neutral passage 35 and the tank 19 when the operation valves 21 to 23 in the first circuit system 20 are switched.

The neutral cut valve 37 has a communication position 37*a* for allowing communication of the second neutral passage 35, and a block position 37*b* for blocking the second neutral passage 35. Normally, the neutral cut valve 37 is placed at the communication position 37*a* due to biasing force of a return spring. The neutral cut valve 37 is switched to the block position 37*b* by a pilot pressure supplied to a pilot chamber 37*c*.

An opening/closing valve 38 is provided upstream of the pilot chamber 37*c*. The opening/closing valve 38 opens when a pilot pressure in the first pilot passage 65 (will be described later) is higher than a pilot pressure in the second pilot passage 75 by a predetermined pressure difference set up in advance or higher. This predetermined pressure difference set up in advance is a pressure difference between the first pilot passage 65 and the second pilot passage 75 in a case where only the operation valves 21 to 23 are switched.

In this regard, for example, in a case where only the operation valves 21 to 23 in the first circuit system 20 can be switched independently and the operation valves 31 to 34 in the second circuit system 30 can be switched only at the same time as the operation valves 21 to 23, there is no need that the neutral cut valve 27 is provided, that is to say, it is sufficient to provide only the neutral cut valve 37. As such, it is sufficient to provide the neutral cut valve 27 or 37 in at least one of the first circuit system 20 and the second circuit system 30.

The communication switching valve 40 has a normal position 40*a*, a first communication position 40*b*, and a second communication position 40*c*. At the normal position 40*a*, the communication switching valve 40 blocks communication between the first neutral passage 25 and the second neutral passage 35. At the first communication position 40*b*, the communication switching valve 40 allows the working oil to flow only from the first neutral passage 25 to the second neutral passage 35. At the second communication position 40*c*, the communication switching valve 40 allows the working oil to flow only from the second neutral passage 35 to the first neutral passage 25. Normally, the communication switching valve 40 is placed at the normal position 40*a* due to biasing forces of a pair of centering springs. The communication switching valve 40 is switched to the first communication position 40*b* by a pilot pressure supplied to a first pilot chamber 40*d*, and switched to the second communication position 40*c* by a pilot pressure acting on a second pilot chamber 40*e*.

An opening/closing valve 42 is provided upstream of the first pilot chamber 40*d*. The opening/closing valve 42 opens when a pilot pressure in the second pilot passage 75 is higher than a pilot pressure in the first pilot passage 65 by a predetermined pressure difference set up in advance or higher. The opening/closing valve 42 opens or closes at the same timing as the opening/closing valve 28 for switching a pilot pressure acting on the pilot chamber 27*c* of the neutral cut valve 27.

Similarly, an opening/closing valve 41 is provided upstream of the second pilot chamber 40*e*. The opening/closing valve 41 opens when a pilot pressure in the first pilot passage 65 (will be described later) is higher than a pilot pressure in the second pilot passage 75 by a predetermined pressure difference set up in advance or higher. The opening/closing valve 41 opens or closes at the same timing as the opening/closing valve 38 for switching a pilot pressure acting on the pilot chamber 37*c* of the neutral cut valve 37.

The discharge flow rate adjusting mechanism 50 includes a first high-pressure selection circuit 60, a second high-pressure selection circuit 70, a shuttle valve 80, a switching valve 81, and a differential pressure reduction valve 82. The first high-pressure selection circuit 60 selects the highest one of pilot pressures for switching the operation valves 21 to 23 to allow communication of the selected pilot pressure. The second high-pressure selection circuit 70 selects the highest one of pilot pressures for switching the operation valves 31 to 34 to allow communication of the selected pilot pressure. The shuttle valve 80 serving as a high-pressure selection valve selects higher one of pilot pressures guided from the first high-pressure selection circuit 60 and the second high-pressure selection circuit 70 to cause the selected pilot pressure to act on the regulator 11. The switching valve 81 is switched by a pilot pressure guided from the first high-pressure selection circuit 60 and a pilot pressure guided from the second high-pressure selection circuit 70. The differential pressure reduction valve 82 reduces the pilot pressure acting on the regulator 11 as a pressure difference between the pilot pressures guided from the first high-pressure selection circuit 60 and the second high-pressure selection circuit 70 increases.

The first high-pressure selection circuit 60 includes shuttle valves 61, 62, and 63. The shuttle valve 61 selects higher one of the pilot pressures in the pilot passages 21*a*, 21*b* to allow communication of the selected pilot pressure. The shuttle valve 62 selects higher one of the pilot pressures in the pilot passages 22*a*, 22*b* to allow communication of the selected pilot pressure. The shuttle valve 63 selects higher one of the pilot pressures in the pilot passages 23*a*, 23*b* to allow communication of the selected pilot pressure. The pilot pressures guided from the shuttle valves 61 to 63 join in the first pilot passage 65 via check valves 61*a* to 63*a* that prevent a reverse flow of the working oil. The first high-pressure selection circuit 60 selects the highest one of the pilot pressures in the pilot passages 21*a*, 21*b*, 22*a*, 22*b*, 23*a*, 23*b* to guide the selected pilot pressure to the second pilot chamber 40*e* of the communication switching valve 40 and the pilot chamber 37*c* of the neutral cut valve 37.

The second high-pressure selection circuit 70 includes shuttle valves 71, 72, 73, and 74. The shuttle valve 71 selects higher one of the pilot pressures in the pilot passages 31*a*, 31*b* to allow communication of the selected pilot pressure. The shuttle valve 72 selects higher one of the pilot pressures in the pilot passages 32*a*, 32*b* to allow communication of the selected pilot pressure. The shuttle valve 73 selects higher one of the pilot pressures in the pilot passages 33*a*, 33*b* to allow communication of the selected pilot pressure. The shuttle valve 74 selects higher one of the pilot pressures in the pilot passages 34*a*, 34*b* to allow communication of the selected pilot pressure. The pilot pressures guided from the shuttle valves 71 to 74 join in the second pilot passage 75 via check valves 71*a* to 74*a* that prevent a reverse flow of the working oil. The second high-pressure selection circuit 70 selects the highest one of the pilot pressures in the pilot passages 31*a*, 31*b*, 32*a*, 32*b*, 33*a*, 33*b*, 34*a*, 34*b* to guide the selected pilot pressure to the first pilot chamber 40*d* of the communication switching valve 40 and the pilot chamber 27*c* of the neutral cut valve 27.

Figure 3:
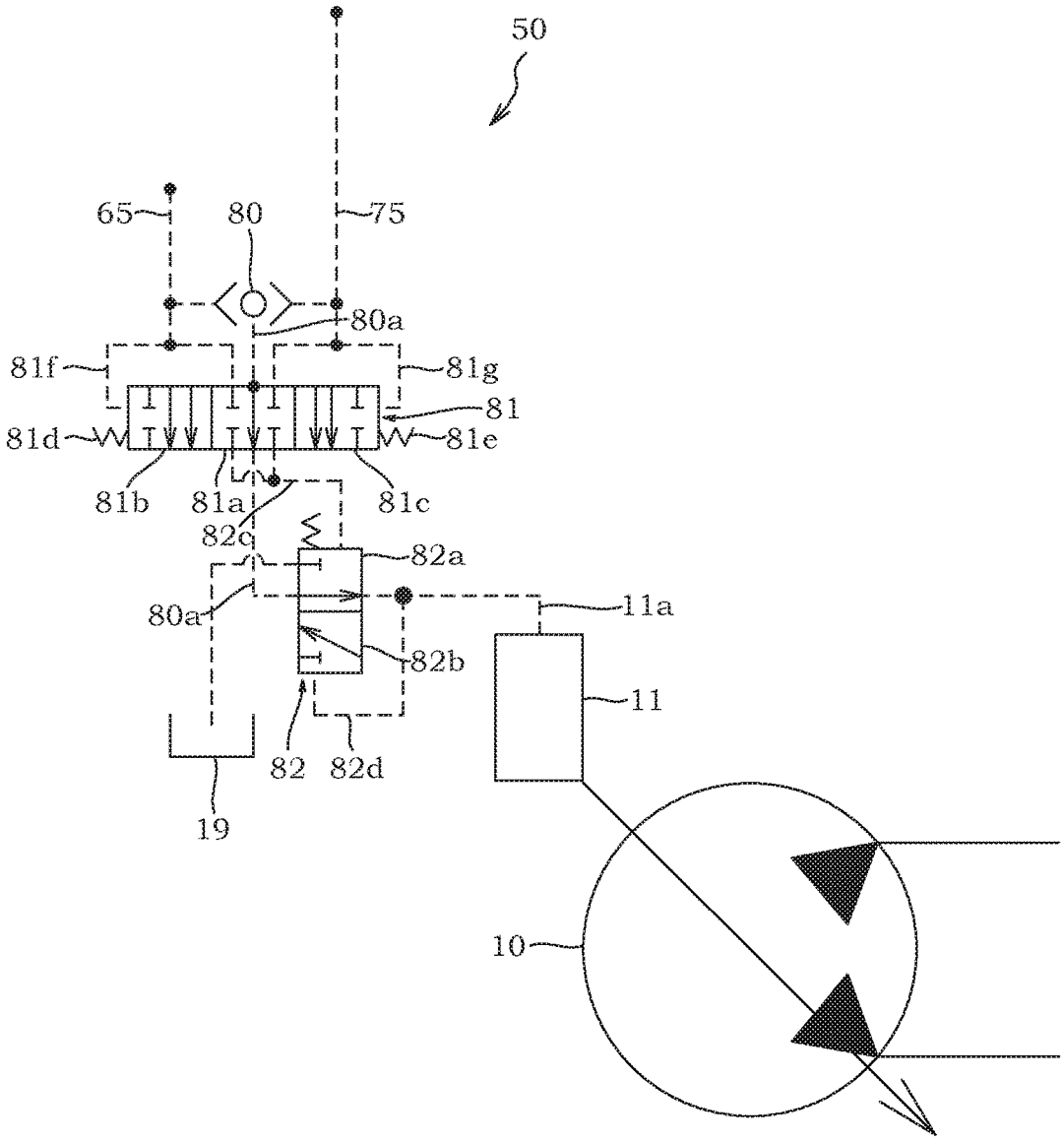
FIG. 3 is an enlarged view of a part of a discharge flow rate adjusting device shown in FIG. 2.

As shown in FIG. 3, the shuttle valve 80 selects any one of the working oil in the first pilot passage 65 and the working oil in the second pilot passage 75, which has a higher pressure than the other, to guide the selected working oil to a pilot passage 11*a* of the regulator 11 via a pilot passage 80*a*.

The switching valve 81 blocks higher one of the pilot pressure guided from the first pilot passage 65 and the pilot pressure guided from the second pilot passage 75, and causes lower one of them to act on the differential pressure reduction valve 82.

The switching valve 81 has a normal position 81*a*, a first switching position 81*b*, and a second switching position 81*c*. At the normal position 81*a*, the switching valve 81 blocks the working oil from the first pilot passage 65 and the second pilot passage 75, and allows communication of only the working oil from the pilot passage 80*a*. At the first switching position 81*b*, the switching valve 81 allows communication of the working oil from the second pilot passage 75 and the working oil from the pilot passage 80*a*. At the second switching position 81*c*, the switching valve 81 allows communication of the working oil from the first pilot passage 65 and the working oil from the pilot passage 80*a*. The switching valve 81 includes a spool (not shown in the drawings). Biasing force of a centering spring 81*d* and a pilot pressure in a pilot passage 81*f* act on one side of the spool. Biasing force of a centering spring 81*e* and a pilot pressure in a pilot passage 81*g* act on the other side of the spool. The pressure of the working oil in the first pilot passage 65 is guided to the pilot passage 81*f*, and the pressure of the working oil in the second pilot passage 75 is guided to the pilot passage 81*g*.

In a case where no pilot pressure is supplied to the first pilot passage 65 and the second pilot passage 75, the switching valve 81 is switched to the normal position 81*a* by the biasing forces of the centering springs 81*d*, 81*e*.

In a case where the pilot pressure in the first pilot passage 65 is higher than the pilot pressure in the second pilot passage 75, the switching valve 81 is switched to the first switching position 81*b* by the pilot pressure in the pilot passage 81*f*. In this way, the pilot pressure in the first pilot passage 65, which is higher than the pilot pressure in the second pilot passage 75, passes through the shuttle valve 80 and is guided from the pilot passage 80*a* to the pilot passage 11*a*. In addition, the pilot pressure in the second pilot passage 75, which is lower than the pilot pressure in the first pilot passage 65, is guided to the differential pressure reduction valve 82 via a pilot passage 82*c*.

On the other hand, in a case where the pilot pressure in the second pilot passage 75 is higher than the pilot pressure in the first pilot passage 65, the switching valve 81 is switched to the second switching position 81*c* by the pilot pressure in the pilot passage 81*g*. In this way, the pilot pressure in the second pilot passage 75, which is higher than the pilot pressure in the first pilot passage 65, passes through the shuttle valve 80 and is guided from the pilot passage 80*a* to the pilot passage 11*a*. In addition, the pilot pressure in the first pilot passage 65, which is lower than the pilot pressure in the second pilot passage 75, is guided to the differential pressure reduction valve 82 via the pilot passage 82*c*.

The differential pressure reduction valve 82 has a communication position 82*a* and a pressure reducing position 82*b*. At the communication position 82*a*, the differential pressure reduction valve 82 allows the pilot passage 80*a* and the pilot passage 11*a* to communicate with each other. At the pressure reducing position 82*b*, the differential pressure reduction valve 82 reduces the pilot pressure in the pilot passage 11*a* by returning a part of the working oil in the pilot passage 11*a* to the tank 19. Normally, the differential pressure reduction valve 82 is placed at the communication position 82*a* due to biasing force of a return spring. The differential pressure reduction valve 82 is switched to the communication position 82*a* by the biasing force of the return spring and a pilot pressure in the pilot passage 82*c*, and switched to the pressure reducing position 82*b* by a pilot pressure in a pilot passage 82*d* guided from the pilot passage 11*a*. Therefore, the differential pressure reduction valve 82 returns more working oil to the tank 19 as the pilot pressure in the pilot passage 82*d* increases compared with the pilot pressure in the pilot passage 82*c*.

In a case where the differential pressure reduction valve 82 is placed at the communication position 82*a*, higher one of the pilot pressures in the first pilot passage 65 and the second pilot passage 75 is guided to the pilot passage 11*a*. On the other hand, lower one of the pilot pressures in the first pilot passage 65 and the second pilot passage 75 is guided to the pilot passage 82*c*. Therefore, the differential pressure reduction valve 82 reduces the pilot pressure acting on the regulator 11 as a pressure difference between the pilot pressures guided from the first pilot passage 65 and the second pilot passage 75 increases.

Hereinafter, an operation of the control system 100 will be described.

First, a case where none of all of the actuators in the hydraulic excavator 1 is operated and all of the operation valves 21 to 23 in the first circuit system 20 and the operation valves 31 to 34 in the second circuit system 30 are respectively placed at the normal positions will be described.

Working oil discharged from the hydraulic pump 10 is supplied to the first discharge passage 15 and the second discharge passage 16 on a pro rata basis, and respectively guided to the first neutral passage 25 and the second neutral passage 35.

At this time, since all of the operation valves 21 to 23 and the operation valves 31 to 34 are placed at the normal positions, all of the pilot pressures to be inputted to the first high-pressure selection circuit 60 and the second high-pressure selection circuit 70 in the discharge flow rate adjusting mechanism 50 are zero. Since there is no pressure difference between the first pilot passage 65 and the second pilot passage 75, both the opening/closing valves 41 and 42 close, and the communication switching valve 40 is placed at the normal position 40*a*. Further, both the opening/closing valves 28 and 38 close, and the neutral cut valves 27 and 37 are placed at the communication positions 27*a* and 37*a*, respectively. Therefore, the working oil guided to the first neutral passage 25 and the second neutral passage 35 is returned to the tank 19.

Further, since both of the pilot pressures in the first pilot passage 65 and the second pilot passage 75 are also zero, no pilot pressure is supplied to the pilot passage 11*a*. Therefore, in a case where none of all of the operation valves 21 to 23, 31 to 34 is operated, a pilot pressure acting on the regulator 11 from the pilot passage 11*a* is zero, and the discharge flow rate of the hydraulic pump 10 is thus adjusted to the minimum discharge flow rate.

Next, a case where both the operation valves 21 to 23 and the operation valves 31 to 34 are switched will be described using, as an example, a case where the operation lever is operated in a full stroke so as to cause both of the boom 6 and the arm 7 in the hydraulic excavator 1 to pivot.

In the discharge flow rate adjusting mechanism 50, the operation valve 22 for operating the boom 6 is switched to the first switching position or the second switching position, and the operation valve 34 for operating the arm 7 is switched to the first switching position or the second switching position. The pilot pressure is inputted from the pilot passage 22*a* or the pilot passage 22*b* to the first high-pressure selection circuit 60. In the first high-pressure selection circuit 60, the pilot pressure in the pilot passage 22*a* or the pilot passage 22*b* is guided to the first pilot passage 65. On the other hand, the pilot pressure is inputted from the pilot passage 34*a* or the pilot passage 34*b* to the second high-pressure selection circuit 70. In the second high-pressure selection circuit 70, the pilot pressure in the pilot passage 34*a* or the pilot passage 34*b* is guided to the second pilot passage 75.

Magnitude of the pilot pressure in the first pilot passage 65 is different from that of the pilot pressure in the second pilot passage 75 due to pipe resistance and the like. A case where the pilot pressure in the first pilot passage 65 is higher than the pilot pressure in the second pilot passage 75 will be described herein.

Since a pressure difference between the pilot pressure in the first pilot passage 65 and the pilot pressure in the second pilot passage 75 is attributed to the pipe resistance and the like, the pressure difference does not exceed a predetermined pressure difference set up in advance. Therefore, both the opening/closing valves 41 and 42 close, and the communication switching valve 40 is placed at the normal position 40*a*. Further, both the opening/closing valves 28 and 38 close, and the neutral cut valves 27 and 37 are placed at the communication positions 27*a* and 37*a*, respectively. Accordingly, residual working oil that is not guided to the boom cylinder 6*a* or the arm cylinder 7*a* of the working oil guided to the first neutral passage 25 and the second neutral passage 35 is returned to the tank 19.

Further, since the pilot pressure in the first pilot passage 65 is higher than the pilot pressure in the second pilot passage 75, the shuttle valve 80 selects the pilot pressure in the first pilot passage 65 to allow the selected pilot pressure to communicate with the pilot passage 80*a*. The pilot pressure guided from the first pilot passage 65 to the pilot passage 81*f* overpowers the pilot pressure guided from the second pilot passage 75 to the pilot passage 81*g*. The switching valve 81 is thus switched to the first switching position 81*b*.

Consequently, the pilot pressure in the first pilot passage 65, which has been selected by the shuttle valve 80, is guided to the regulator 11 of the hydraulic pump 10 via the pilot passage 80*a* and the pilot passage 11*a*.

Further, in the differential pressure reduction valve 82, the pilot pressure in the first pilot passage 65 is guided to the pilot passage 82*d*, and the pilot pressure in the second pilot passage 75 is guided to the pilot passage 82*c*. Here, since a pressure difference between the pilot passage 82*c* and the pilot passage 82*d* is small, the biasing force of the return spring and the pilot pressure in the pilot passage 82*c* overpower the pilot pressure in the pilot passage 82*d*. Consequently, the differential pressure reduction valve 82 is switched to the communication position 82*a*, and the pilot pressure in the first pilot passage 65 is thus guided from the pilot passage 11*a* to the regulator 11. Therefore, in a case where both the operation valve 22 and the operation valve 34 are operated, the discharge flow rate of the hydraulic pump 10 is adjusted to the maximum discharge flow rate.

Next, a case where only one group of the operation valves 21 to 23 and the operation valves 31 to 34 is switched will be described using, as an example, a case where an operation is performed so as to cause only the boom 6 of the hydraulic excavator 1 to pivot and a case where an operation is performed so as to cause only the arm 7 thereof to pivot.

When the operator operates the operation lever so as to cause the boom 6 to pivot, the pilot pressure is supplied from the pilot passage 22*a* or the pilot passage 22*b*, and the operation valve 22 is thus switched to the first or second switching position. Consequently, a part of the working oil guided from the first discharge port 12 of the hydraulic pump 10 to the first circuit system 20 is guided from the operation valve 22 to the boom cylinder 6*a*.

At this time, since the operation valve 22 is switched to the first or second switching position, the pilot pressure in the pilot passage 22*a* or 22*b* passes through the shuttle valve 62 and the check valve 62*a*, and is guided to the first pilot passage 65 in the discharge flow rate adjusting mechanism 50. On the other hand, since all of the operation valves 31 to 34 are placed at the normal positions, all of the pilot pressures inputted to the second high-pressure selection circuit 70 are zero. Therefore, the pilot pressure in the second pilot passage 75 is zero.

Since the pilot pressure in the first pilot passage 65 is higher than the pilot pressure in the second pilot passage 75 by a predetermined pressure difference set up in advance or higher, the opening/closing valves 38 and 41 open. Consequently, the communication switching valve 40 is switched to the second communication position 40*c*, and the neutral cut valve 37 is switched to the block position 37*b*.

At this time, since the neutral cut valve 37 is switched to the block position 37*b*, the working oil in the second neutral passage 35 is not returned to the tank 19. Therefore, the working oil supplied from the hydraulic pump 10 to the second neutral passage 35 via the second discharge passage 16 joins in the first neutral passage 25 via the communication switching valve 40.

Further, since the pilot pressure in the first pilot passage 65 is high and the pilot pressure in the second pilot passage 75 is zero, the shuttle valve 80 selects the pilot pressure in the first pilot passage 65 to allow the selected pilot pressure to communicate with the pilot passage 80*a*. The pilot pressure guided from the first pilot passage 65 to the pilot passage 81*f* overpowers the pilot pressure guided from the second pilot passage 75 to the pilot passage 81*g*. The switching valve 81 is thus switched to the first switching position 81*b*.

Consequently, the pilot pressure in the first pilot passage 65, which is selected by the shuttle valve 80, is guided to the regulator 11 of the hydraulic pump 10 via the pilot passage 80*a* and the pilot passage 11*a*.

Further, in the differential pressure reduction valve 82, the pilot pressure in the first pilot passage 65 is guided to the pilot passage 82*d*, and the pilot pressure in the second pilot passage 75 is guided to the pilot passage 82*c*. Here, since the pressure difference between the pilot passage 82*c* and the pilot passage 82*d* is large, the differential pressure reduction valve 82 is switched to the pressure reducing position 82*b*. This increases the working oil returned from the pilot passage 11*a* to the tank 19. Therefore, in a case where only the operation valve 22 is operated, the pilot pressure acting on the regulator 11 is reduced, and the hydraulic pump 10 is adjusted so as to reduce the discharge flow rate thereof.

As described above, the working oil joins from the second neutral passage 35, along which the operation valves 31 to 34 are not operated, to the first neutral passage 25, along which the operation valve 22 is operated. In addition, the discharge flow rate adjusting mechanism 50 reduces the discharge flow rate of the hydraulic pump 10. Therefore, by using the working oil that has been conventionally returned to the tank 19, it is possible to secure the flow rate of the working oil necessary for the operations of the actuators even though the discharge flow rate of the hydraulic pump 10 is reduced. As a result, energy efficiency can be improved.

On the other hand, when the operator operates the operation lever so as to cause the arm 7 to pivot, the pilot pressure is supplied from the pilot passage 34*a* or the pilot passage 34*b*, and the operation valve 34 is thus switched to the first or second switching position. Consequently, a part of the working oil guided from the second discharge port 13 of the hydraulic pump 10 to the second circuit system 30 is guided from the operation valve 34 to the arm cylinder 7*a*.

At this time, since the operation valve 34 is switched to the first or second switching position, the pilot pressure in the pilot passage 34*a* or 34*b* is guided to the second pilot passage 75 through the shuttle valve 74 and the check valve 74*a* in the discharge flow rate adjusting mechanism 50. On the other hand, since all of the operation valves 21 to 23 are placed at the normal positions, all of the pilot pressures inputted to the first high-pressure selection circuit 60 are zero. Therefore, the pilot pressure in the first pilot passage 65 is zero.

Since the pilot pressure in the second pilot passage 75 is higher than the pilot pressure in the first pilot passage 65 by a predetermined pressure difference set up in advance or higher, the opening/closing valves 28 and 42 open. Consequently, the communication switching valve 40 is switched to the first communication position 40*b*, and the neutral cut valve 27 is switched to the block position 27*b*.

At this time, since the neutral cut valve 27 is switched to the block position 27*b*, the working oil in the first neutral passage 25 is not returned to the tank 19. Therefore, the working oil supplied from the hydraulic pump 10 to the first neutral passage 25 via the first discharge passage 15 joins in the second neutral passage 35 via the communication switching valve 40.

Further, since the pilot pressure in the second pilot passage 75 is high and the pilot pressure in the first pilot passage 65 is zero, the shuttle valve 80 selects the pilot pressure in the second pilot passage 75 to allow the selected pilot pressure to communicate with the pilot passage 80*a*. The pilot pressure guided from the second pilot passage 75 to the pilot passage 81*g* overpowers the pilot pressure guided from the first pilot passage 65 to the pilot passage 81*f*. The switching valve 81 is thus switched to the second switching position 81*c*.

Consequently, the pilot pressure in the second pilot passage 75, which is selected by the shuttle valve 80, is guided to the regulator 11 of the hydraulic pump 10 via the pilot passage 80*a* and the pilot passage 11*a*.

Further, in the differential pressure reduction valve 82, the pilot pressure in the second pilot passage 75 is guided to the pilot passage 82*d*, and the pilot pressure in the first pilot passage 65 is guided to the pilot passage 82*c*. Here, since the pressure difference between the pilot passage 82*c* and the pilot passage 82*d* is large, the differential pressure reduction valve 82 is switched to the pressure reducing position 82*b*. This increases the working oil returned from the pilot passage 11*a* to the tank 19. Therefore, in a case where only the operation valve 34 is operated, the pilot pressure acting on the regulator 11 is reduced, and the hydraulic pump 10 is adjusted so as to reduce the discharge flow rate thereof.

As described above, the working oil joins from the first neutral passage 25, along which the operation valves 21 to 23 are not operated, to the second neutral passage 35, along which the operation valve 34 is operated. In addition, the discharge flow rate adjusting mechanism 50 reduces the discharge flow rate of the hydraulic pump 10. Therefore, by using the working oil that has been conventionally returned to the tank 19, it is possible to secure the flow rate of the working oil necessary for the operations of the actuators even though the discharge flow rate of the hydraulic pump 10 is reduced. As a result, the energy efficiency can be improved.

According to the first embodiment described above, the following advantageous effects can be achieved.

In a case where an actuator is operated by operating one group of the operation valves 21 to 23 in the first circuit system 20 and the operation valves 31 to 34 in the second circuit system 30, the communication switching valve 40 allows the first neutral passage 25 and the second neutral passage 35 to communicate with each other due to the pilot pressure for switching the operation valves 21 to 23 or 31 to 34, and the neutral cut valve 27 or 37 blocks the first neutral passage 25 or the second neutral passage 35 along which the operation valves 21 to 23 or 31 to 34 are not operated.

Consequently, the working oil joins from one of the first circuit system 20 and the second circuit system 30, in which the operation valves 21 to 23 or 31 to 34 are not operated, to the other of the first circuit system 20 and the second circuit system 30, in which the operation valves 21 to 23 or 31 to 34 are operated. Further, at this time, the discharge flow rate adjusting mechanism 50 reduces the discharge flow rate of the hydraulic pump 10. Therefore, by using the working oil that has been conventionally returned to the tank 19, it is possible to secure the flow rate of the working oil necessary for the operations of the actuators even though the discharge flow rate of the hydraulic pump 10 is reduced. As a result, the energy efficiency can be improved.

Figure 4:
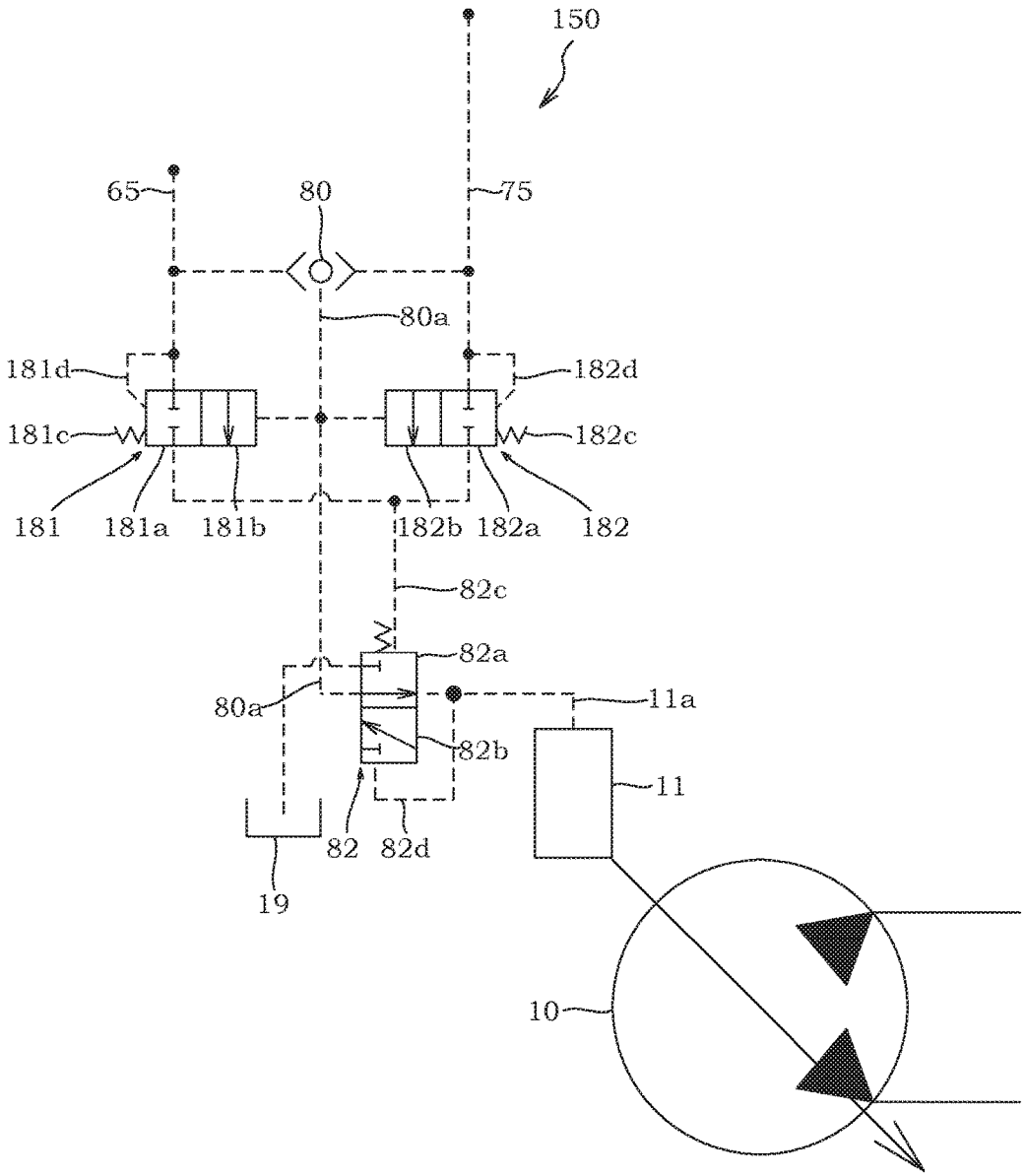
FIG. 4 is a view for explaining a variant example of the discharge flow rate adjusting device.

Next, a discharge flow rate adjusting mechanism 150 according to a variant example of the discharge flow rate adjusting device will be described mainly with reference to FIG. 4. The discharge flow rate adjusting mechanism 150 is different from the discharge flow rate adjusting mechanism 50 in that a first switching valve 181 and a second switching valve 182 are provided in place of the single switching valve 81.

The discharge flow rate adjusting mechanism 150 includes a first high-pressure selection circuit 60, a second high-pressure selection circuit 70, a shuttle valve 80, a first switching valve 181, a second switching valve 182, and a differential pressure reduction valve 82. The first high-pressure selection circuit 60 selects the highest one of pilot pressures for switching operation valves 21 to 23 to allow communication of the selected pilot pressure. The second high-pressure selection circuit 70 selects the highest one of pilot pressures for switching operation valves 31 to 34 to allow communication of the selected pilot pressure. The shuttle valve 80 serving as a high-pressure selection valve selects higher one of pilot pressures guided from the first high-pressure selection circuit 60 and the second high-pressure selection circuit 70 to cause the selected pilot pressure to act on a regulator 11. The first switching valve 181 serving as a switching valve is switched by the pressure of the working oil selected by the shuttle valve 80 and the pilot pressure guided from the first high-pressure selection circuit 60. The second switching valve 182 serving as a switching valve is switched by the pressure of the working oil selected by the shuttle valve 80 and the pilot pressure guided from the second high-pressure selection circuit 70. The differential pressure reduction valve 82 reduces the pilot pressure acting on the regulator 11 as a pressure difference between the pilot pressures guided from the first high-pressure selection circuit 60 and the second high-pressure selection circuit 70 increases.

The first switching valve 181 has a block position 181*a* for blocking working oil from a first pilot passage 65, and a communication position 181*b* for allowing communication of the working oil from the first pilot passage 65. The first switching valve 181 includes a spool (not shown in the drawings). A pilot pressure in a pilot passage 80*a* acts on one side of the spool. Biasing force of a return spring 181*c* and a pilot pressure in a pilot passage 181*d* act on the other side of the spool. The pressure of the working oil in the first pilot passage 65 is guided to the pilot passage 181*d*.

Similarly, the second switching valve 182 has a block position 182*a* for blocking working oil from a second pilot passage 75, and a communication position 182*b* for allowing communication of the working oil from the second pilot passage 75. The second switching valve 182 includes a spool (not shown in the drawings). A pilot pressure in the pilot passage 80*a* acts on one side of the spool. Biasing force of a return spring 182*c* and a pilot pressure in a pilot passage 182*d* act on the other side of the spool. The pressure of the working oil in the second pilot passage 75 is guided to the pilot passage 182*d*.

One of the first switching valve 181 and the second switching valve 182 is switched to the communication position 181*b* or 182*b* by the pressure of the working oil selected by the shuttle valve 80, and working oil that has passed therethrough is guided to the pilot passage 82*c* as a pilot pressure.

In a case where the discharge flow rate adjusting mechanism 150 is used in this manner, higher one of a pilot pressure in the first pilot passage 65 and a pilot pressure in the second pilot passage 75 is guided to the pilot passage 82*d*, and lower one of these pilot pressures is guided to the pilot passage 82*c* in the differential pressure reduction valve 82 as well as the discharge flow rate adjusting mechanism 50. Therefore, in a case where the discharge flow rate adjusting mechanism 150 is used, the discharge flow rate of the hydraulic pump 10 can be adjusted as well as the discharge flow rate adjusting mechanism 50.

Second Embodiment

Figure 5:
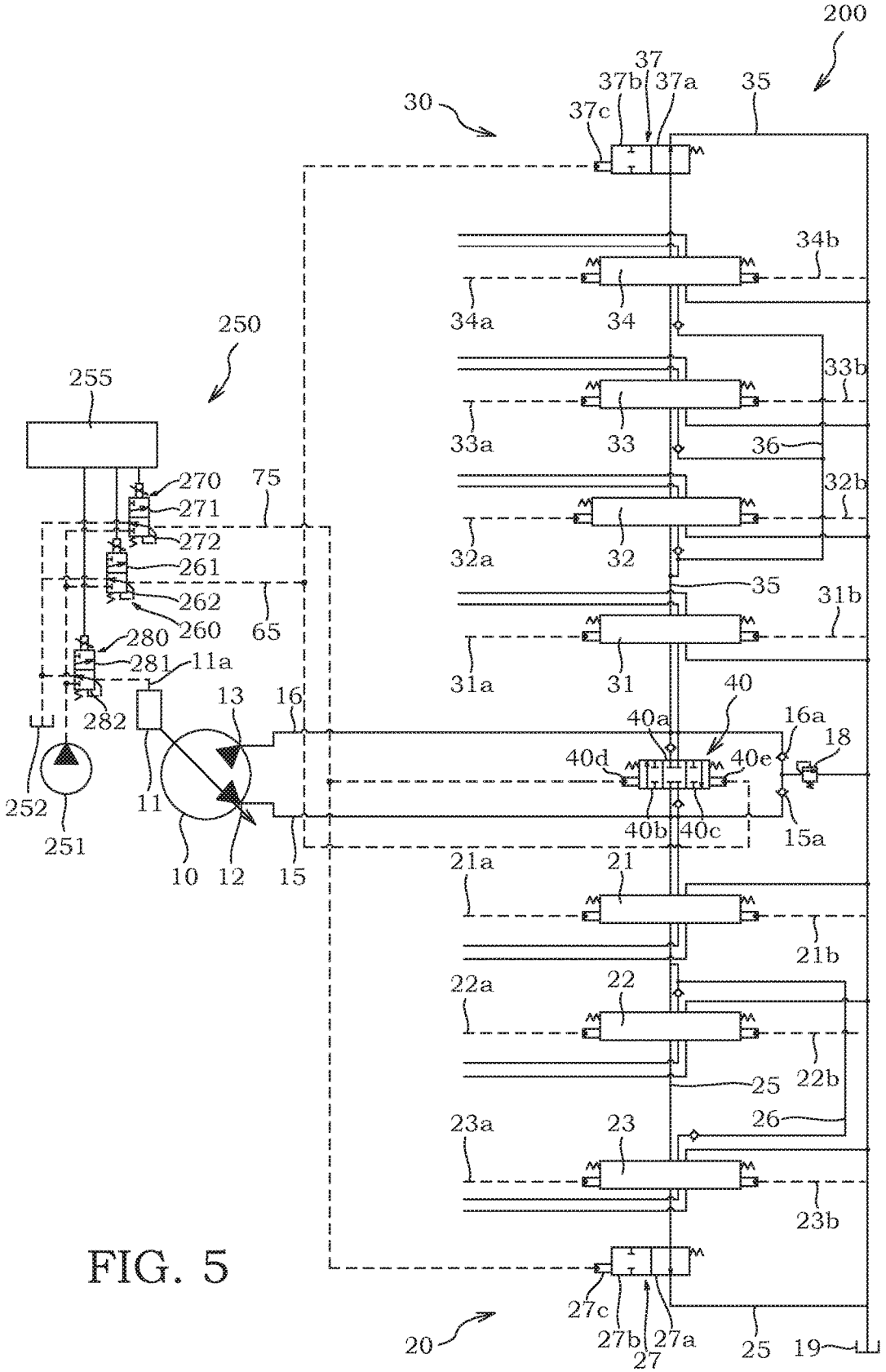
FIG. 5 is a circuit diagram of the working machine control system according to the second embodiment of the present invention.

Hereinafter, a working machine control system (hereinafter, referred to simply as a "control system") 200 according to a second embodiment of the present invention will be described with reference to FIG. 5. In the following of the second embodiment, points different from the first embodiment described above are focused on. Components that have the similar functions to those of the first embodiment are denoted by the same reference numerals, and explanation thereof is omitted.

The control system 200 is different from the first embodiment in that a discharge flow rate adjusting mechanism 250 is provided as a discharge flow rate adjusting device controlled by a controller 255 in place of the discharge flow rate adjusting mechanism 50 or 150. In the control system 200, electric signals outputted by an operation for switching the operation valves 21 to 23 or the operation valves 31 to 34 corresponds to a switch signal. This electric signals are, for example, a signal from a pressure sensor (not shown in the drawings) that detects a pilot pressure acting on the operation valves 21 to 23 or 31 to 34, a signal from a displacement sensor (not shown in the drawings) that detects an operation of an operation lever by an operator.

The discharge flow rate adjusting mechanism 250 includes a pilot pump 251, a first pressure reduction valve 260, a second pressure reduction valve 270, a third pressure reduction valve 280, and a drain 252. The pilot pump 251 generates a pilot pressure. The first pressure reduction valve 260 is controlled when an electric signal is inputted only from the operation valves 21 to 23. The second pressure reduction valve 270 is controlled when an electric signal is inputted only from the operation valves 31 to 34. The third pressure reduction valve 280 is controlled when an electric signal is inputted from one group of the operation valves 21 to 23 and the operation valves 31 to 34. The drain 252 discharges the working oil in a case where a pilot pressure in a first pilot passage 65, a pilot pressure in a second pilot passage 75, or a pilot pressure acting on a regulator 11 is to be reduced.

The first pressure reduction valve 260 has a communication position 261 for guiding the pilot pressure from the pilot pump 251 to the first pilot passage 65, and a pressure reducing position 262 for reducing the pilot pressure in the first pilot passage 65 by discharging part of the working oil in the first pilot passage 65 to the drain 252. Normally, the first pressure reduction valve 260 is placed at the pressure reducing position 262 due to biasing force of a return spring and the pilot pressure from the first pilot passage 65. When an electric signal is inputted only from the operation valves 21 to 23, the first pressure reduction valve 260 is switched to the communication position 261 by the controller 255 to guide the pilot pressure from the pilot pump 251 to a second pilot chamber 40*e* of a communication switching valve 40 and to a pilot chamber 37*c* of a neutral cut valve 37.

The second pressure reduction valve 270 has a communication position 271 for guiding the pilot pressure from the pilot pump 251 to the second pilot passage 75, and a pressure reducing position 272 for reducing the pilot pressure in the second pilot passage 75 by discharging part of the working oil in the second pilot passage 75 to the drain 252. Normally, the second pressure reduction valve 270 is placed at the pressure reducing position 272 due to biasing force of a return spring and the pilot pressure from the second pilot passage 75. When an electric signal is inputted only from the operation valves 31 to 34, the second pressure reduction valve 270 is switched to the communication position 271 by the controller 255 to guide the pilot pressure from the pilot pump 251 to a first pilot chamber 40*d* of the communication switching valve 40 and to a pilot chamber 27*c* of a neutral cut valve 27.

The third pressure reduction valve 280 has a communication position 281 for guiding the pilot pressure from the pilot pump 251 to a pilot passage 11*a*, and a pressure reducing position 282 for reducing the pilot pressure in the pilot passage 11*a* by discharging part of the working oil in the pilot passage 11*a* to the drain 252. Normally, the third pressure reduction valve 280 is placed at the pressure reducing position 282 due to biasing force of a return spring and a pilot pressure from the pilot passage 11*a*. When an electric signal is inputted from the operation valves 21 to 23 or the operation valves 31 to 34, the third pressure reduction valve 280 is switched to the pressure reducing position 282 by the controller 255 to reduce the pilot pressure guided from the pilot pump 251 to the regulator 11.

In the control system 200, the controller 255 controls the first pressure reduction valve 260, the second pressure reduction valve 270, and the third pressure reduction valve 280, whereby it is possible to separately adjust the pilot pressures in the first pilot passage 65, the second pilot passage 75, and the pilot passage 11*a*. Therefore, there is no need to provide opening/closing valves 28, 38, 41, 42, which are provided in the control system 100 according to the first embodiment, in the control system 200.

Hereinafter, an operation of the control system 200 will be described.

First, a case where none of all actuators in the hydraulic excavator 1 is operated and all of the operation valves 21 to 23 in the first circuit system 20 and the operation valves 31 to 34 in the second circuit system 30 are placed at the normal positions will be described.

Working oil discharged from the hydraulic pump 10 is supplied to a first discharge passage 15 and a second discharge passage 16 on a pro rata basis, and guided to a first neutral passage 25 and a second neutral passage 35.

At this time, since all of the operation valves 21 to 23 and the operation valves 31 to 34 are placed at the normal positions, in the discharge flow rate adjusting mechanism 250, the controller 255 respectively controls the first pressure reduction valve 260 and the second pressure reduction valve 270 into the pressure reducing position 262 and the pressure reducing position 272 so as to discharge the pilot pressures in the first pilot passage 65 and the second pilot passage 75 to the drain 252. Further, the controller 255 also controls the third pressure reduction valve 280 into the pressure reducing position 282 so as to discharge the pilot pressure from the pilot passage 11*a* to the drain 252.

At this time, the communication switching valve 40 is placed at the normal position 40*a*. Therefore, the first neutral passage 25 and the second neutral passage 35 do not communicate with each other. In addition, the neutral cut valves 27 and 37 are placed at the communication positions 27*a* and 37*a*, respectively. Therefore, working oil guided to the first neutral passage 25 and the second neutral passage 35 is returned to the tank 19. In a case where none of the operation valves 21 to 23, 31 to 34 is operated, a discharge flow rate of the hydraulic pump 10 is adjusted to the minimum discharge flow rate because the pilot pressure acting on the regulator 11 from the pilot passage 11*a* is zero.

Next, a case where both the operation valves 21 to 23 and the operation valves 31 to 34 are switched will be described using, as an example, a case where both of a boom 6 and an arm 7 of the hydraulic excavator 1 are operated so as to pivot.

In the discharge flow rate adjusting mechanism 250, an electric signal for switching the operation valve 22, which operates the boom 6, and an electric signal for switching the operation valve 34, which operates the arm 7, are inputted to the controller 255. Since it is not a state where an electric signal is inputted only from the operation valves 21 to 23, the controller 255 controls the first pressure reduction valve 260 into the pressure reducing position 262. Similarly, since it is not a state where an electric signal is inputted only from the operation valves 31 to 34, the controller 255 controls the second pressure reduction valve 270 into the pressure reducing position 272. Further, the controller 255 switches the third pressure reduction valve 280 into the communication position 281 so as to supply the pilot pressure from the pilot passage 11*a* to the regulator 11.

At this time, the communication switching valve 40 is placed at the normal position 40*a*. Therefore, the first neutral passage 25 and the second neutral passage 35 do not communicate with each other. In addition, the neutral cut valves 27 and 37 are placed at the communication positions 27*a* and 37*a*, respectively. Therefore, the working oil guided to the first neutral passage 25 and the second neutral passage 35 is returned to the tank 19. In a case where the operation valves 22 and 34 are operated, the hydraulic pump 10 is adjusted to the maximum discharge flow rate because the pilot pressure acting on the regulator 11 from the pilot passage 11*a* becomes the maximum.

Although the case where the pilot pressure acting on the regulator 11 is controlled so as to become the maximum has been described, it is not limited to this case. The controller 255 outputs an electric signal corresponding to the magnitude of a load of each of the actuators to the third pressure reduction valve 280 to control the pilot pressure guided from the pilot pump 251 to the regulator 11.

Next, a case where only one group of the operation valves 21 to 23 and the operation valves 31 to 34 is switched will be described using, as an example, a case where only the boom 6 of the hydraulic excavator 1 is operated so as to pivot and a case where only the arm 7 thereof is operated so as to pivot.

In a case where only the boom 6 is operated so as to pivot, only an electric signal for switching the operation valve 22, which operates the boom 6, is inputted to the controller 255 in the discharge flow rate adjusting mechanism 250. Since it is a state where an electric signal is inputted only from the operation valves 21 to 23, the controller 255 switches the first pressure reduction valve 260 into the communication position 261. On the contrary, since it is not the state where an electric signal is inputted only from the operation valves 31 to 34, the controller 255 controls the second pressure reduction valve 270 into the pressure reducing position 272.

In this way, the pilot pressure from the pilot pump 251 passes through the first pressure reduction valve 260, and is guided to the first pilot passage 65. Therefore, the communication switching valve 40 is switched to the second communication position 40*c*, and the neutral cut valve 37 is switched to the block position 37*b*.

Since the neutral cut valve 37 is switched to the block position 37*b*, the working oil in the second neutral passage 35 is not returned to the tank 19. Therefore, the working oil supplied from the hydraulic pump 10 to the second neutral passage 35 via the second discharge passage 16 joins in the first neutral passage 25 via the communication switching valve 40.

Further, the controller 255 also switches the third pressure reduction valve 280 to the pressure reducing position 282 in accordance with an operation amount of the operation valve 22. Accordingly, part of the pilot pressure in the regulator 11 is guided to the drain 252 to reduce the pilot pressure acting on the regulator 11. Therefore, in a case where only the operation valve 22 is operated, the hydraulic pump 10 is adjusted so as to reduce the discharge flow rate thereof.

As described above, the working oil joins from the second neutral passage 35, along which the operation valves 31 to 34 are not operated, to the first neutral passage 25, along which the operation valve 22 is operated. In addition, the discharge flow rate adjusting mechanism 250 reduces the discharge flow rate of the hydraulic pump 10. Therefore, by using the working oil that has been conventionally returned to the tank 19, it is possible to secure the flow rate of the working oil necessary for the operations of the actuators even though the discharge flow rate of the hydraulic pump 10 is reduced. As a result, the energy efficiency can be improved.

On the other hand, in a case where only the arm 7 is operated so as to pivot, only an electric signal for switching the operation valve 34, which operates the arm 7, is inputted to the controller 255 in the discharge flow rate adjusting mechanism 250. Since it is not a state where an electric signal is inputted only from the operation valves 21 to 23, the controller 255 controls the first pressure reduction valve 260 into the pressure reducing position 262. On the contrary, since it is a state where an electric signal is inputted only from the operation valves 31 to 34, the controller 255 switches the second pressure reduction valve 270 to the communication position 271.

In this way, the pilot pressure from the pilot pump 251 passes through the second pressure reduction valve 270, and is guided to the second pilot passage 75. Therefore, the communication switching valve 40 is switched to the first communication position 40*b*, and the neutral cut valve 27 is switched to the block position 27*b*.

Since the neutral cut valve 27 is switched to the block position 27*b*, the working oil in the first neutral passage 25 is not returned to the tank 19. Therefore, the working oil supplied from the hydraulic pump 10 to the first neutral passage 25 via the first discharge passage 15 joins in the second neutral passage 35 via the communication switching valve 40.

Further, the controller 255 also switches the third pressure reduction valve 280 to the pressure reducing position 282 in accordance with an operation amount of the operation valve 34. Accordingly, part of the pilot pressure in the regulator 11 is guided to the drain 252 to reduce the pilot pressure acting on the regulator 11. Therefore, in a case where only the operation valve 34 is operated, the hydraulic pump 10 is adjusted so as to reduce the discharge flow rate thereof.

As described above, the working oil joins from the first neutral passage 25, along which the operation valves 21 to 23 are not operated, to the second neutral passage 35, along which the operation valve 34 is operated. In addition, the discharge flow rate adjusting mechanism 250 reduces the discharge flow rate of the hydraulic pump 10. Therefore, by using the working oil that has been conventionally returned to the tank 19, it is possible to secure the flow rate of the working oil necessary for the operations of the actuators even though the discharge flow rate of the hydraulic pump 10 is reduced. As a result, the energy efficiency can be improved.

According to the second embodiment described above, the similar effects to those achieved by the first embodiment can be achieved. Further, in the control system 200 according to the second embodiment, since the control is carried out by the controller 255, the similar control can be carried out with a simple configuration compared with the control system 100 according to the first embodiment.

In the second embodiment described above, the controller 255 controls the third pressure reduction valve 280 to adjust the pilot pressure acting on the regulator 11 and the discharge flow rate of the hydraulic pump 10. Alternatively, an apparatus that adjusts the number of revolution of an engine for driving the hydraulic pump 10 may be applied as a discharge flow rate adjusting device so as to be capable of adjusting the discharge flow rate of the hydraulic pump 10 in accordance with the number of revolution of the engine.

The embodiments of the present invention have been described above, but the above embodiments are merely examples of applications of the present invention, and the technical scope of the present invention is not limited to the specific configurations of the above embodiments.

The present application claims priority based on Japanese Patent Application No. 2014-016495 filed with the Japan Patent Office on Jan. 31, 2014, the entire content of which is incorporated into this specification by reference.

The invention claimed is:

1. A working machine control system configured to control a working machine including a first actuator and a second actuator, the working machine control system comprising:

a split-flow fluid pressure pump configured to discharge a working fluid from a first discharge port and a second discharge port;

a first circuit system to which the working fluid discharged from the first discharge port is supplied, the first circuit system including a first operation valve and a first neutral passage, the first operation valve being configured to control the first actuator, the first neutral passage allowing the first discharge port to communicate with a tank in a state where the first operation valve is placed at a normal position;

a second circuit system to which the working fluid discharged from the second discharge port is supplied, the second circuit system including a second operation valve and a second neutral passage, the second operation valve being configured to control the second actuator, the second neutral passage allowing the second discharge port to communicate with the tank in a state where the second operation valve is placed at a normal position;

a communication switching valve configured to be switched by a switch signal when any one of the first operation valve and the second operation valve is switched so as to allow the first neutral passage and the second neutral passage to communicate with each other;

a neutral cut valve provided in at least one of the first circuit system and the second circuit system, the neutral cut valve being configured to be switched by the switch signal so as to block communication between the tank and one of the first neutral passage and the second neutral passage for the other of the first operation valve and the second operation valve that is not switched; and a discharge flow rate adjusting device configured to adjust the fluid pressure pump so as to reduce a discharge flow rate of the fluid pressure pump in a case where the switch signal is inputted from any one of the first operation valve and the second operation valve.

2. The working machine control system according to claim 1, wherein the fluid pressure pump includes a swash plate whose inclination angle is adjusted by a single regulator to be controlled by a pilot pressure, and the inclination angle of the swash plate is adjusted in such a manner that the higher the pilot pressure acting on the regulator is, the more the discharge flow rate increases.

3. The working machine control system according to claim 2, wherein the switch signal is a pilot pressure for switching the first operation valve or the second operation valve, wherein the neutral cut valve includes a first neutral cut valve provided in the first circuit system and a second neutral cut valve provided in the second circuit system, and wherein the discharge flow rate adjusting device includes:

a first high-pressure selection circuit configured to select the highest one of pilot pressures for switching the first operation valve to guide the selected pilot pressure to the communication switching valve and the second neutral cut valve by allowing communication of the selected pilot pressure so as to allow the first neutral passage and the second neutral passage to communicate with each other and block communication between the second neutral passage and the tank;

a second high-pressure selection circuit configured to select the highest one of pilot pressures for switching the second operation valve to guide the selected pilot pressure to the communication switching valve and the first neutral cut valve by allowing communication of the selected pilot pressure so as to allow the first neutral passage and the second neutral passage to communicate with each other and block communication between the first neutral passage and the tank;

a high-pressure selection valve configured to select higher one of the pilot pressures guided from the first high-pressure selection circuit and the second high-pressure selection circuit to cause the selected pilot pressure to act on the regulator; and a differential pressure reduction valve configured to reduce the pilot pressure acting on the regulator as a pressure difference between the pilot pressures guided from the first high-pressure selection circuit and the second high-pressure selection circuit increases.

4. The working machine control system according to claim 3, wherein the discharge flow rate adjusting device further includes a switching valve that is switched by the pilot pressure guided from the first high-pressure selection circuit and the pilot pressure guided from the second high-pressure selection circuit so that higher one of the pilot pressures guided from the first high-pressure selection circuit and the second high-pressure selection circuit is blocked and lower one of the pilot pressures is caused to act on the differential pressure reduction valve, and wherein the differential pressure reduction valve reduces the pilot pressure acting on the regulator as a pressure difference between the pilot pressure acting on the regulator and the pilot pressure acting through the switching valve increases.

5. The working machine control system according to claim 2, wherein the switch signal is an electric signal outputted via a switching operation for the first operation valve or the second operation valve, wherein the neutral cut valve includes a first neutral cut valve provided in the first circuit system and a second neutral cut valve provided in the second circuit system, and wherein the discharge flow rate adjusting device includes:

a pilot pump configured to generate a pilot pressure;

a first pressure reduction valve configured to guide, when the electric signal is inputted only from the first operation valve, the pilot pressure from the pilot pump to the communication switching valve and the second neutral cut valve so as to allow the first neutral passage and the second neutral passage to communicate with each other and block communication between the second neutral passage and the tank;

a second pressure reduction valve configured to guide, when the electric signal is inputted only from the second operation valve, the pilot pressure from the pilot pump to the communication switching valve and the first neutral cut valve so as to allow the first neutral passage and the second neutral passage to communicate with each other and block communication between the first neutral passage and the tank; and a third pressure reduction valve configured to reduce, when the electric signal is inputted from any one of the first operation valve and the second operation valve, the pilot pressure guided from the pilot pump to the regulator.

* * * * *